US009468243B2

(12) United States Patent
Rothschild et al.

(10) Patent No.: US 9,468,243 B2
(45) **Date of Patent: *Oct. 18, 2016**

(54) DETACHABLE WRIST COACH

(71) Applicant: Sound Shore Innovations L.L.C., Darien, CT (US)

(72) Inventors: Kyle D. Rothschild, Stamford, CT (US); Joseph King, Darien, CT (US)

(73) Assignee: Sound Shore Innovations L.L.C., Darien, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/002,485

(22) Filed: Jan. 21, 2016

(65) Prior Publication Data

US 2016/0135522 A1 May 19, 2016

Related U.S. Application Data

(63) Continuation-in-part of application No. 14/294,357, filed on Jun. 3, 2014, now Pat. No. 9,271,531.

(60) Provisional application No. 61/962,700, filed on Nov. 15, 2013.

(51) Int. Cl.

| | |
|---|---|
| ***A41D 20/00*** | (2006.01) |
| ***A41D 27/20*** | (2006.01) |
| ***A41D 13/08*** | (2006.01) |

(52) U.S. Cl.

CPC ..... *A41D 20/00* (2013.01); *A41D 13/08* (2013.01); *A41D 27/201* (2013.01); *A41D 2300/32* (2013.01); *A41D 2400/48* (2013.01)

(58) Field of Classification Search

CPC .. A41D 13/08; A41D 13/085; A41D 13/082; A41D 19/00; A41D 20/00; A63B 71/148

USPC ..... 2/16, 17, 20, 159, 161.1, 163, 170

See application file for complete search history.

(56) References Cited

U.S. PATENT DOCUMENTS

| | | | |
|---|---|---|---|
| 4,341,331 | A | 7/1982 | McDougall |
| 4,884,297 | A | 12/1989 | Triche |
| 5,020,711 | A | 6/1991 | Kelley |
| 5,053,028 | A | 10/1991 | Zoia et al. |
| 5,221,031 | A | 6/1993 | Prigmore |

(Continued)

FOREIGN PATENT DOCUMENTS

| | | |
|---|---|---|
| JP | 2005-27981 | 2/2005 |

OTHER PUBLICATIONS

Sports Facilities Group, Inc., Adams 5 View Wrist Coach, Apr. 14, 2014, http://www.sportsfacilitiesgroup.com/store/p/1072/adams-5-view-wrist-coach.

(Continued)

*Primary Examiner* — Tejash Patel

(74) *Attorney, Agent, or Firm* — Mark Nowotarski

(57) ABSTRACT

A detachable wrist coach has a detachable sheet of football plays in a transparent pocket joined to a sweatband by hook-and-loop fasteners. The detachable sheet can be separated from the sweatband so that the sweatband can be cleaned without degrading the transparent pocket or getting water into it. The hook-and-loop fasteners may have a fold over configuration for greater strength while still retaining the ability to be pealed apart.

6 Claims, 9 Drawing Sheets

(56) References Cited

U.S. PATENT DOCUMENTS

| | | | | |
|---|---|---|---|---|
| 5,318,371 | A | 6/1994 | Niewulis | |
| 5,454,185 | A | 10/1995 | Love | |
| 5,557,803 | A | 9/1996 | Granich et al. | |
| 5,704,067 | A | 1/1998 | Brady | |
| 5,749,504 | A | 5/1998 | Bieker | |
| 6,644,694 | B2 | 11/2003 | Seawright | |
| 8,126,143 | B2 | 2/2012 | Daniel et al. | |
| 9,271,531 | B2 * | 3/2016 | Rothschild | A41D 20/00 |
| 2011/0167536 | A1 | 7/2011 | Kellerhals | |
| 2012/0055963 | A1 | 3/2012 | Phair | |

OTHER PUBLICATIONS

Prosthetics and Orthotics International, Material properties of Velcro fastenings, D.L. Bader and.M.J. Pearcy, Oxford Orthopaedic Engineering Centre, Oxford, 1982, 6, 93-96, Apr. 9, 2014.
Velcro Brand, Woven Hook and Loop, Apr. 9, 2014.
3M Industrial Adhesives and Tapes Division, 3M Hook and Loop Fasteners SJ3403 and SJ3404 Nylon Loop and Hook Plain back, Preliminary Technical Data Apr. 2012, Apr. 9, 2014.
English translation JP 2005-027981.

* cited by examiner

DETACHABLE WRIST COACH

COPYRIGHT AND TRADEMARK NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

BACKGROUND OF THE INVENTION

FIG. 1 displays a sports wristband 100 based on US patent application US2011/0167536, "Sports Wristband with Layered Transparent Pockets" (Kellerhals). Said wristband comprises a sweatband 102, a transparent pocket 104, and a transparent pocket flap 106. The transparent pocket is fixedly joined to the sweatband. The transparent pocket flap is hingedly joined 112 to the transparent pocket. Said flap comprises layered transparent windows 114 and a first sheet fastening portion 116. Said sweatband comprises a second sheet fastening portion 118 which corresponds to said first sheet fastening portion on said flap. Thus said flap can be reversibly closed and opened depending upon if the user does or does not want visual access to said first transparent pocket and/or the bottom of said second transparent pocket. Said sheet fastening portions may comprise Velcro® hook and loop joining cloth. Velcro® is a registered trademark of Velcro Industries B. V.

Sweatbands similar to Kellerhals' have been used in American football to hold and display cards with different plays imprinted upon them. A "play" is a planned series of movements by the members of a team. The leader of the team, the Quarterback, may consult said wristband and instruct the other members of the team on which play is to be executed next. Sweatbands used in this manner are termed "wrist coaches".

American football is a vigorous sport that is often played outdoors and in rainy weather. Thus the sweatbands on wrist coaches can become quite soiled and require frequent cleaning. Unfortunately, the transparent pockets on said wrist coaches are degraded by normal washing. The transparent plastic films of said pockets may become cloudy 122 or may trap water 124 after washing. Thus wrist coaches only last for a few wash cycles and must be replaced frequently. If wrist coaches are not washed frequently, then the soiled sweatbands can become sources of infection.

SUMMARY OF THE INVENTION

The summary of the invention is provided as a guide to understanding the invention. It does not necessarily describe the most generic embodiment of the invention. The inventions described herein may be used in any sport or any activity where a user wishes to have a detachable sheet mounted on a sweatband. It may be used, for example, in construction or military applications. The sweatband may be mounted on any appropriate body part, such as a wrist or ankle.

Concept

FIG. 2A illustrates a Detachable Wrist Coach 200 mounted on a user's arm 202. A detachable wrist coach comprises a tubular sweatband 204 and at least one detachable sheet 206. The sheet may be a transparent pocket. There may also be one or more flaps 207 attached to said sheet. The sweatband comprises at least a first sheet fastening portion 208, such as a Velcro strip. Said detachable sheet comprises a corresponding second sheet fastening portion 209. Thus, said sheet may be reversibly attachable to said sweatband such that said sheet can be removed and the sweatband can be washed separately.

FIG. 2B shows said detachable wrist coach 200 on said user's arm with said sheet and flap attached thereto 212.

Construction

FIG. 3A shows a top view of an exemplary sweatband 300. The sweatband comprises a sleeve 302 and one or more first sheet fastening portions 304, 305, 306. The sleeve may be tapered or straight. Three fastening portions are illustrated but there may be as few as one or as many as can be conveniently provided, such five, seven or an arbitrarily large number. The sleeve may comprise water absorbing material, such as cotton. The sleeve may comprise elastic material such as spandex. There may be gaps 308 between said first sheet fastening portions.

FIG. 3B shows a bottom view of an exemplary detachable sheet 310. Said sheet comprises one or more second sheet fastening portions 312, 313, 314. There may be gaps 316 therebetween.

FIG. 3C shows an end view of a detachable wrist coach 320 which comprises the sweatband 300 of FIG. 3A expanded to an open shape with a detachable sheet 310 just above it. The open shape of the sweatband may be described by a radius of curvature 322 that corresponds to the radius of curvature of a user's arm. Said radius of curvature may vary from one end of the sweatband to the other when it is worn by said user according to the relative diameters of different portions of said user's arm. The first sheet fastening portions 304, 305, 306 may have an expanded spacing 324 therebetween depending upon how large said user's arm is along the length of the sweatband.

The detachable sheet 310 may comprise a transparent pocket 328 and said second sheet fastening portions 312, 313, 314. A sheet of paper 326 may be inserted in said transparent pocket. The sheet of paper may have plays imprinted upon it.

FIG. 3D shows the detachable wrist coach of FIG. 3C after the detachable sheet has been attached to the sweatband. The top of said detachable sheet 332 is then curved when worn by a user.

DETAILED DESCRIPTION

The detailed description describes non-limiting exemplary embodiments. Any individual features may be combined with other features as required by different applications for at least the benefits described herein. As used herein, the term "about" means plus or minus 10% of a given value unless specifically indicated otherwise.

Wrist Coach with Recessed Fastening Portions

Figure 3A:
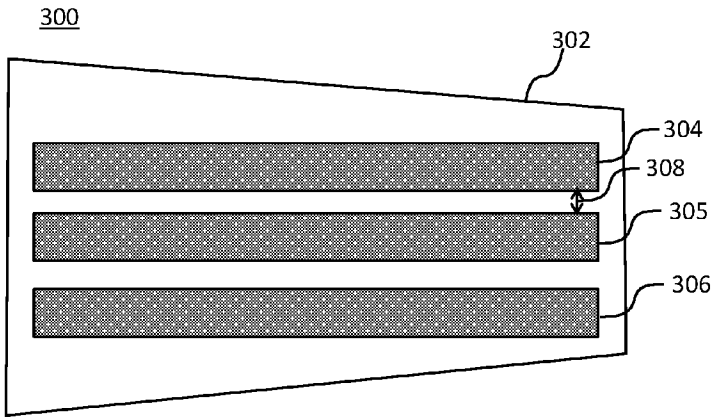
FIGS. 3A to 3D illustrate a detachable wrist coach with a detachable sheet
Figure 3B:
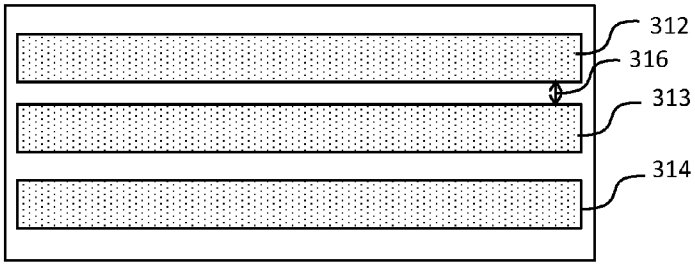
Figure 3C:
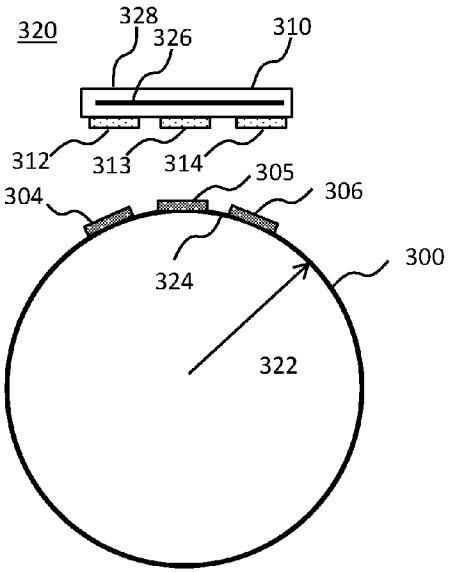
Figure 3D:
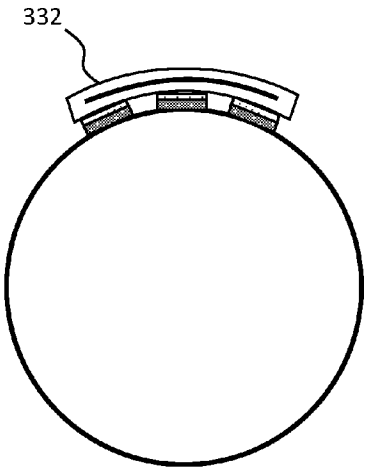
Figure 4B:
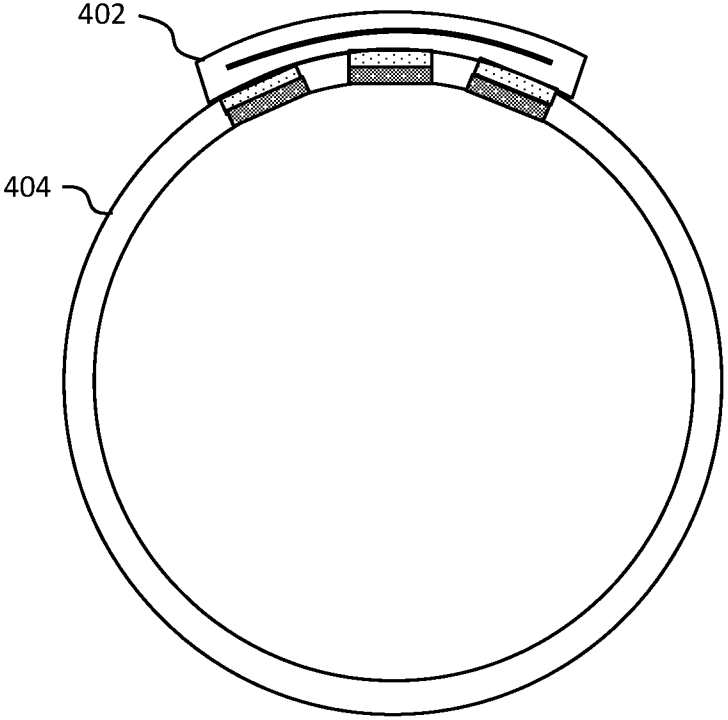
FIGS. 4A to 4B illustrate a detachable wrist coach with recessed fastening portions.
Figure 4A:
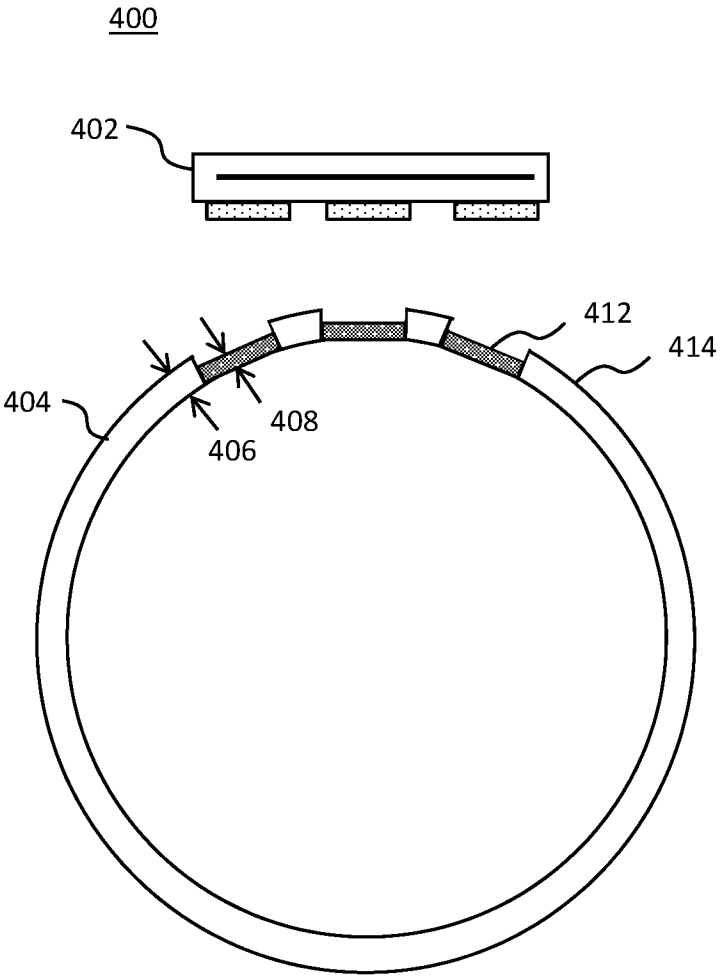

FIG. 4A shows a detachable wrist coach 400 comprising a sweatband 404 and a detachable sheet 402 shown just above it. The construction is similar to the detachable wrist coach 320 of FIG. 3C. The sweatband in this case has at least the same thickness 406 as the first sheet fastening portions 408. Furthermore, said first sheet fastening portion may be recessed within said sweatband such that the top of the first sheet fastening portion 412 is below or flush with the top of said sweatband 414. Thus the detachable sheet 402 will lay flat on said sweatband 404 when joined to said sweatband as shown in FIG. 4B.

Wrist Coach with Flap

Figure 5A:
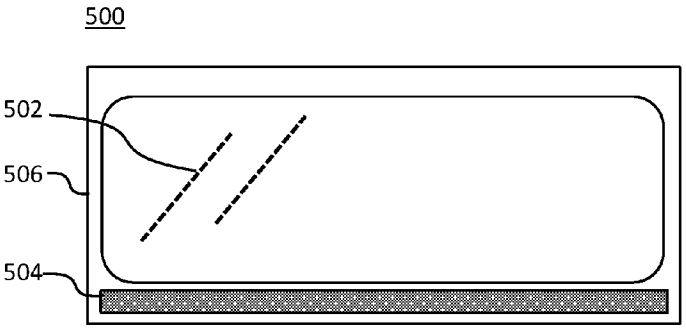
FIG. 5A to 5D illustrate a detachable wrist coach with a flap.

FIGS. 5A through 5D illustrate an alternative detachable wrist coach where the detachable sheet comprises a flap. FIG. 5A shows the top of a detachable sheet 500. The detachable sheet comprises a pocket with a transparent window 502 for viewing a sheet of paper retained therein. The detachable sheet further comprises a first flap fastening portion 504 mounted on a frame 506. The frame may be a flexible material, such as a vinyl sheet. The items may be held together by stitching, gluing or other suitable joining means.

Figure 5B:
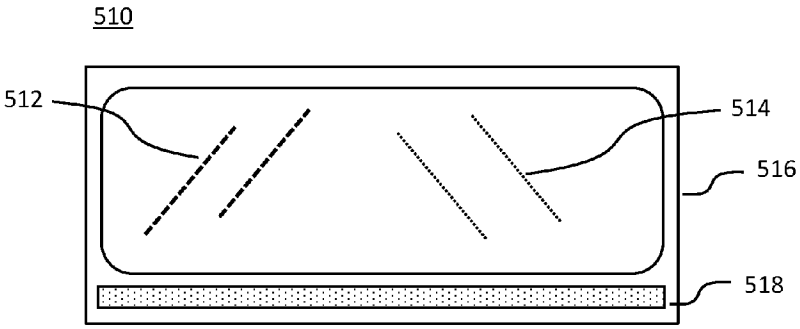

FIG. 5B shows the bottom of a flap 510. Said flap is to be hingedly joined to said sheet. Said flap comprises back-to-back transparent windows 512, 514 held together in a frame 516 to form a flap pocket. Said flap pocket is transparent therethrough so that sheets held therein can be viewed from one side or the other. Said flap comprises a second flap fastening portion 518 that corresponds to said first flap fastening portion.

Figure 5C:
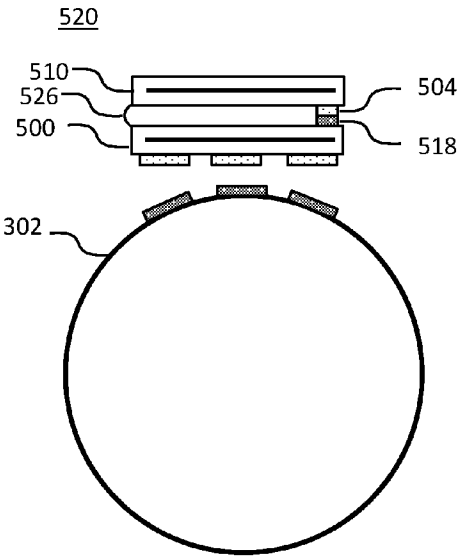

FIG. 5C shows a detachable wrist coach 520 comprising a sweatband 302, a detachable sheet 500 and a flap 510. The detachable sheet is shown above the sweatband. The flap and detachable sheet are joined together by a hinge 526 and said flap fastening portions 504, 518.

Figure 5D:
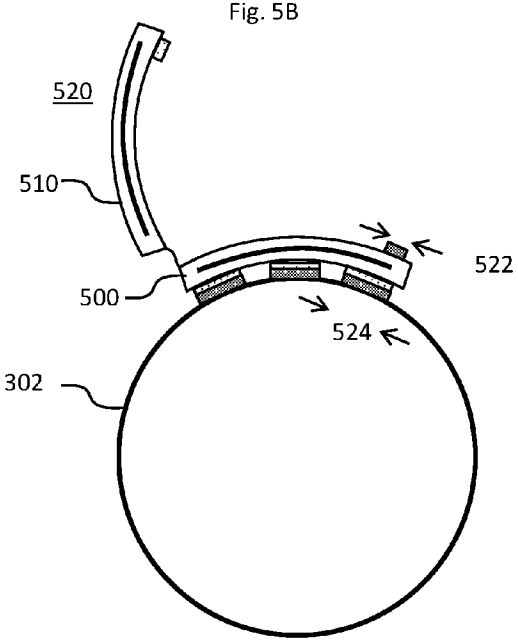

FIG. 5D shows the detachable wrist coach 520 of FIG. 5C with the detachable sheet 500 attached to the sweatband 302 and the flap 510 open. In order for the user to open the flap without removing detachable sheet from the sweatband, the peel strength of the flap fastening portions should be less than the peel strength of the sheet fastening portions. This can be accomplished by having the flap fastening portions have a more narrow width 522 than the width 524 of a sheet fastening portion. The flap fastening portion may also have a smaller area than the sheet fastening portion. The unit peel strength of the flap fastening portions can also be less than the unit peel strength of the sheet fastening portion. Unit peel strength may be expressed as Newtons/cm.

Wrist Coach with Two Flaps

Figure 6B:
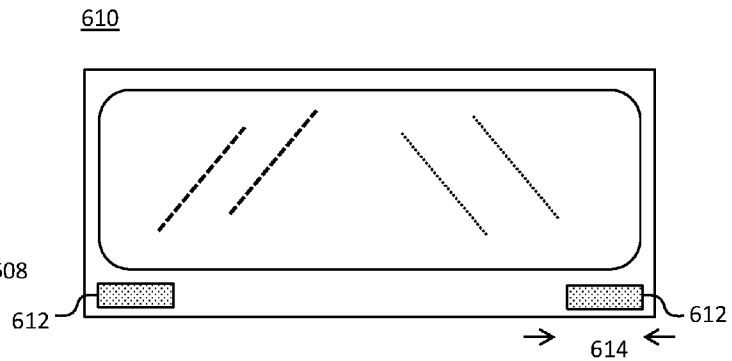
FIGS. 6A to 6D illustrate a detachable wrist coach with two flaps.
Figure 6A:
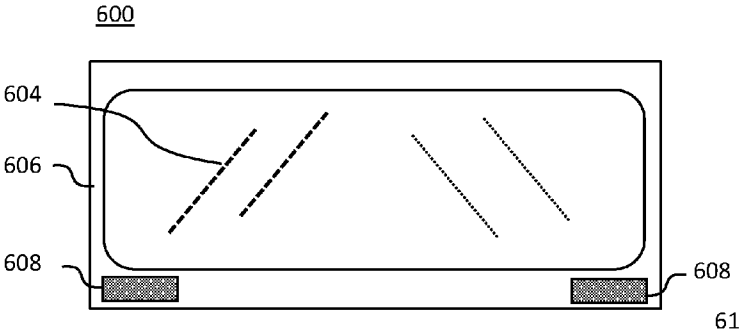

FIGS. 6A through 6D illustrate an alternative detachable wrist coach which comprises two flaps. FIG. 6A shows the top of a first flap 600. Said first flap is similar in construction to the flap 510 of FIG. 5B. The top of said first flap comprises back-to-back transparent windows 604 to form a pocket for holding sheets indicating plays therein and a frame 606. The frame, however, additionally comprises a first top flap fastening portions 608.

FIG. 6B shows the bottom of a second flap 610. Said second flap is similar in construction to said first flap with second top flap fastening portions 612. The width 614 of said top flap fastening portions is less than the width of the flap fastening portions 504, 518 (FIG. 5C) so that the peel strength of the second flap from the first flap will be less than the peel strength of the first flap from the detachable sheet. Hence a user can independently open the first flap and the second flap.

Figure 6D:
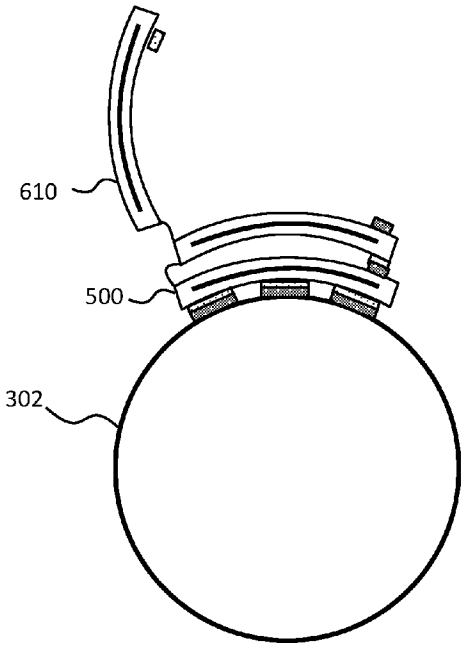
Figure 6C:
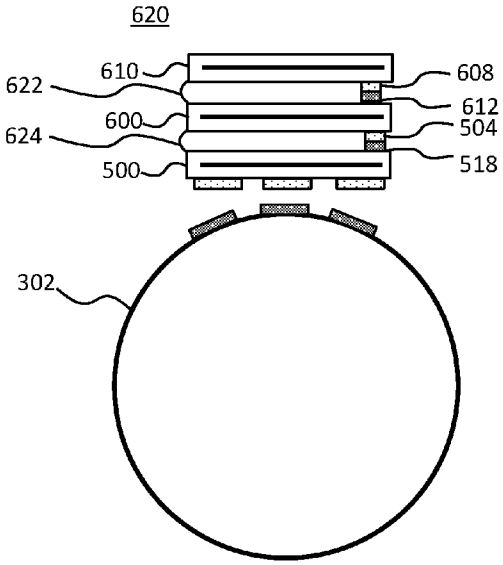

FIG. 6C shows a detachable wrist coach 620 with a detachable sheet 500, a first flap 600 and a second flap 610 all positioned above a sweatband 302. The second flap is joined to the first flap with a second hinge 622 and said top flap fastening portions 608, 612. The first flap is joined to the detachable sheet with a first hinge 624 and with said flap fastening portions 504, 518.

FIG. 6D shows the detachable wrist coach 620 of FIG. 6C with the detachable sheet 500 attached to the sweatband 302 and the top flap 610 open.

Wrist Coach with Flush Top Leaf

Figure 7B:
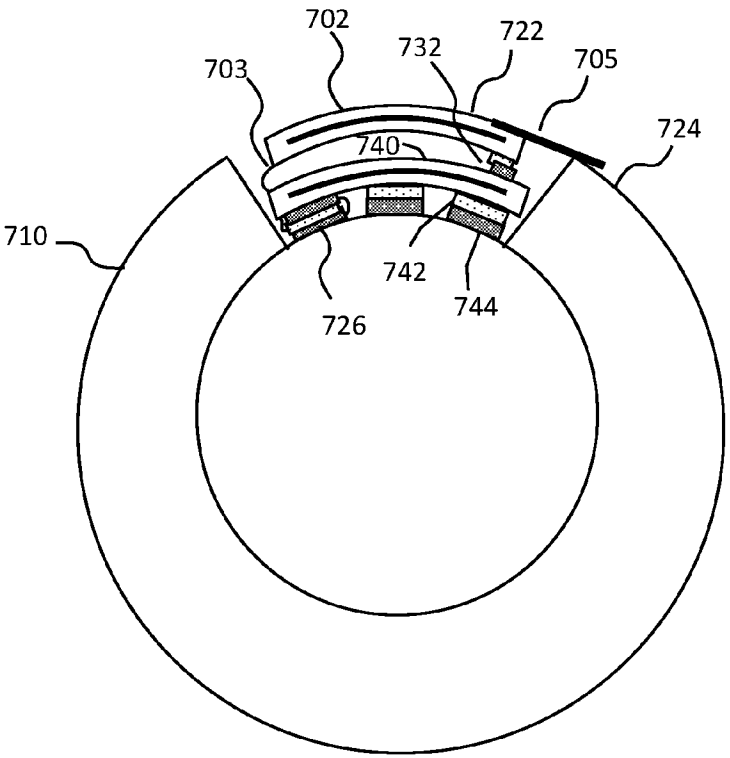
FIGS. 7A to 7B illustrated a detachable wrist coach with a recess in the sweatband.
Figure 7A:
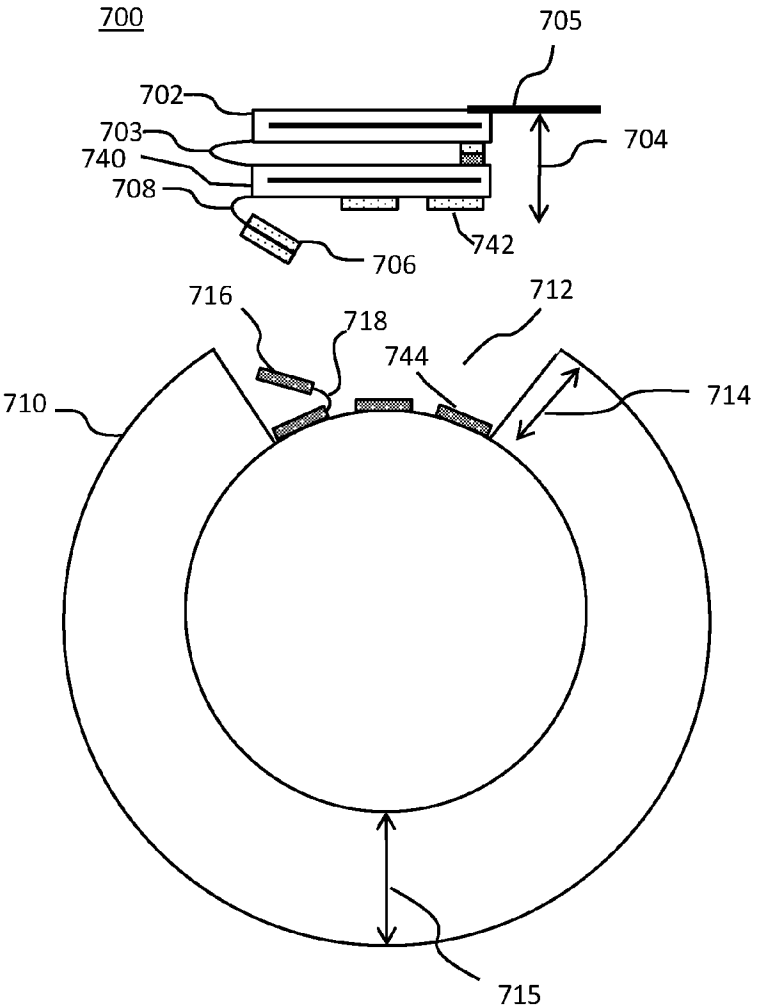

FIG. 7A illustrates a wrist coach 700 with a deeply recessed chamber 712 in a tubular sweatband 710. The depth 714 of the recess is about the same as the depth 704 of the detachable sheet 740 and any flaps 702 that are placed in it. Thus as shown in FIG. 7B, when a detachable sheet and flap are placed in the recess, the top surface 722 of the flap is about flush with the top surface 724 of the sweatband. The thickness of the sweatband 715 (FIG. 7A) does not have to be uniform. It could be narrower, for example, in the back.

FIG. 7A also illustrates a laterally conformable hinge 703. This might be a flexible piece of cloth. Referring to FIG. 7B, the laterally conformable hinge can shift when the leaf and detachable sheet are bent so that the flap fastening portions 732 can remain aligned.

FIG. 7A also illustrates a first fold-over fastening portion 716 attached to the wristband 710 and a second fold-over fastening portion 706 attached to an edge of a detachable sheet 740. The first fold-over fastening portion comprises a fold-over hinge 718, such as a flexible section of cloth. It may also simply be a folded portion of the loop fabric of a hook-and-loop fastening cloth. The second fold-over fastening portion comprises a sheet hinge 708. This might also be a cloth. The second fold-over fastening portion comprises a front and a back side, each of which can join to the first fold-over fastening portion. The front and back sides might be two back-to-back pieces of the hook fabric of a hook-and-loop fastening cloth. Conversely, the first fold-over fastening portion can comprise a hook fabric and the second fold over fastening portion can comprise back to back pieces of loop fabric. Any combination of hook and loop fabrics may be suitable. The wrist band may comprise a first closure portion 744 spaced apart from the first fold-over fastening portion. The detachable sheet may comprise a second closure portion 742 spaced apart from said second fold-over fastening portion and opposite of said first closure portion. The wristband may or may not have a recess 712.

Referring to FIG. 7B, when the detachable wrist coach is assembled 720, the first fold-over fastening portion folds over the second fold-over fastening portion to form a sandwich structure 726 which is particularly resistant to being pulled off, but can be relatively easily opened and peeled off by a user. When the detachable sheet 740 is folded against the wrist band, the first closure portion 744 joins with the second closure portion 742. The first closure portion and second closure portion may be a hook-and-loop fastener.

FIG. 7A also illustrates a tab 705 placed on the flap. Referring to FIG. 7B, the tab may extend over the sweatband to assist a user in peeling open the flap to view the detachable sheet below.

Figure 1:
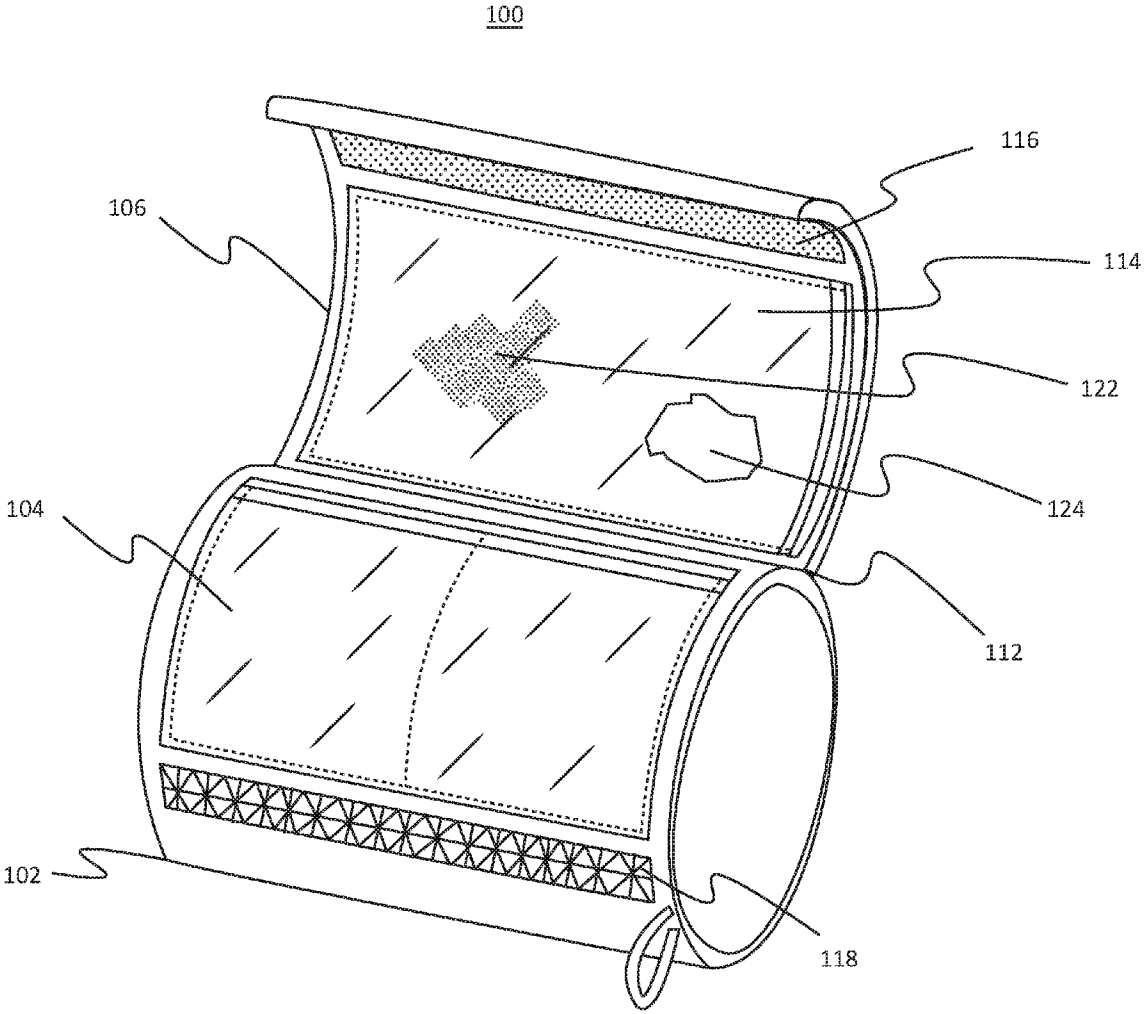
Fig.1 (Prior art)
FIG. 1 is a prior art sports wristband.
Figure 2B:
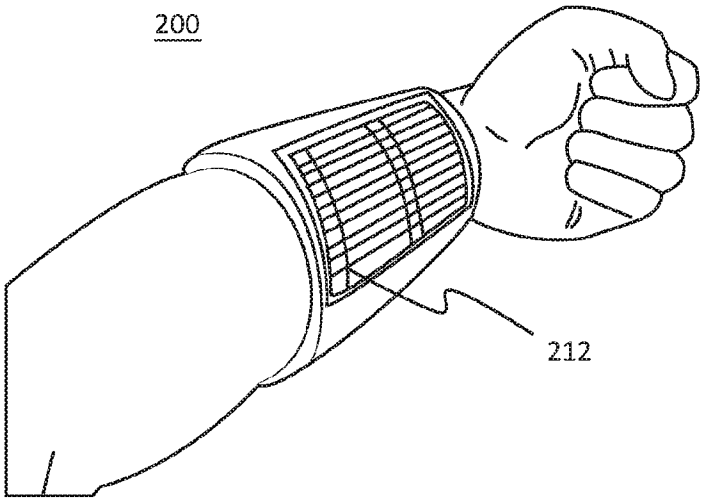
FIGS. 2A and 2B illustrate a detachable wrist coach.
Figure 2A:
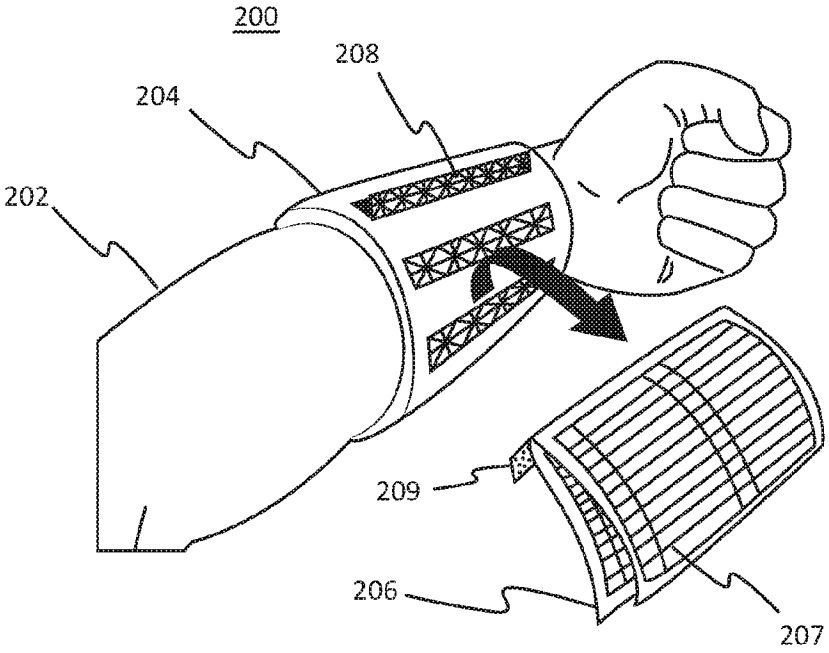
Figure 8:
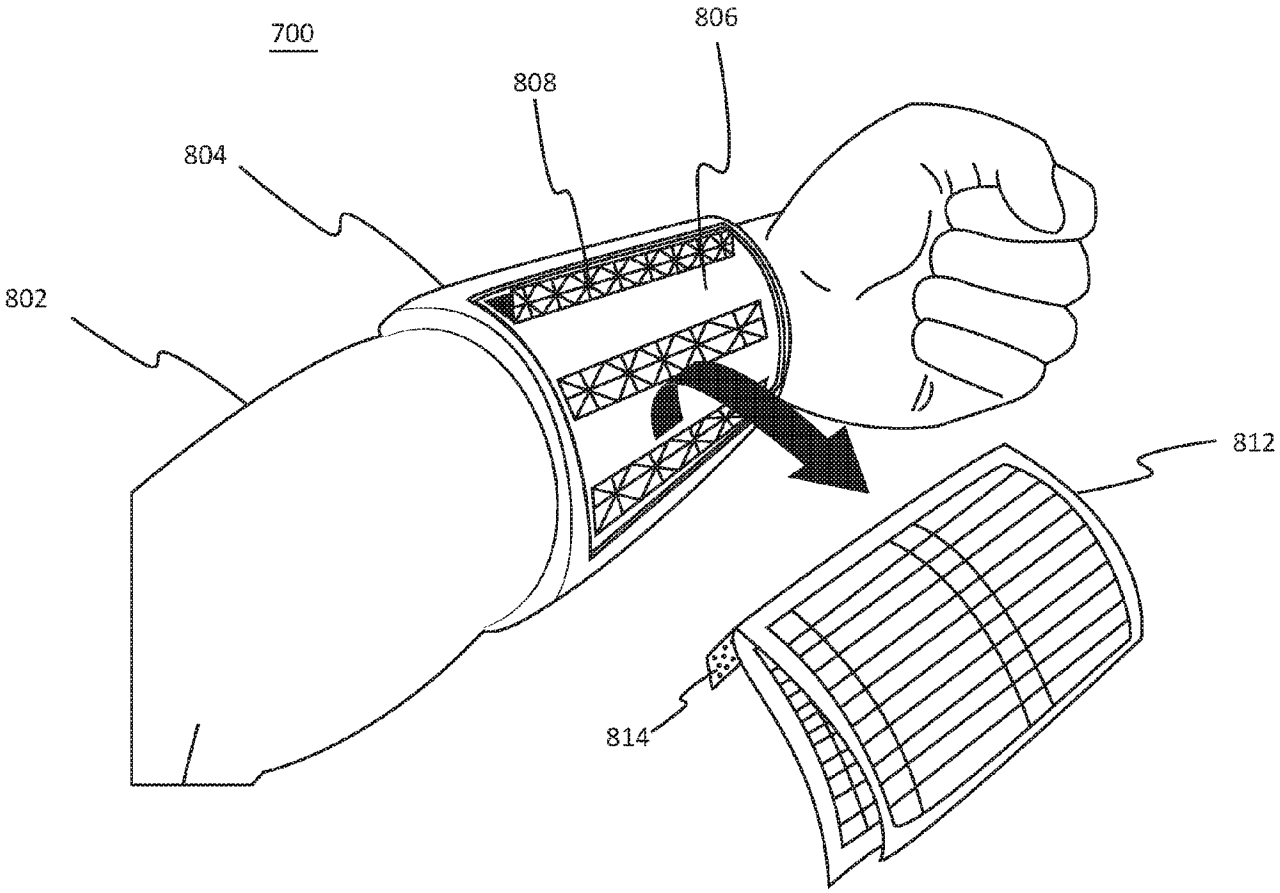
FIG. 8 shows a perspective view of the wrist coach of FIGS. 7A and 7B.

FIG. 8 illustrates the wrist coach 700 of FIGS. 7A and 7B mounted on a user's arm 802. The sweatband 804 has a recessed portion 806 and first sheet joining portions attached at the bottom thereof. A first fold-over fastening portion 808 and second fold-over fastening portion 814 are provided. When mounted with said recess, the top of the leaf 812 will be about flush with the top of the sweatband. Similar first and second fold over fastening portions 208 and 209 are shown in FIG. 2A.

Wrist Coach with Lay-Flat Detachable Sheet

Figure 9A:
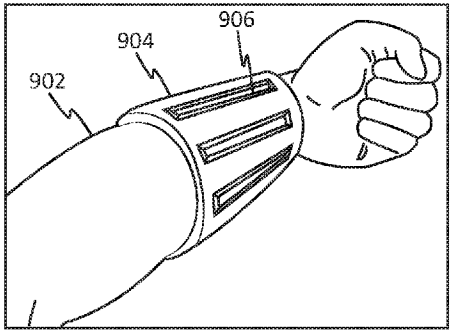
FIGS. 9A and 9B show a perspective view of a wrist coach with a detachable sheet whose bottom is flush with the top of a sweatband.
Figure 9B:
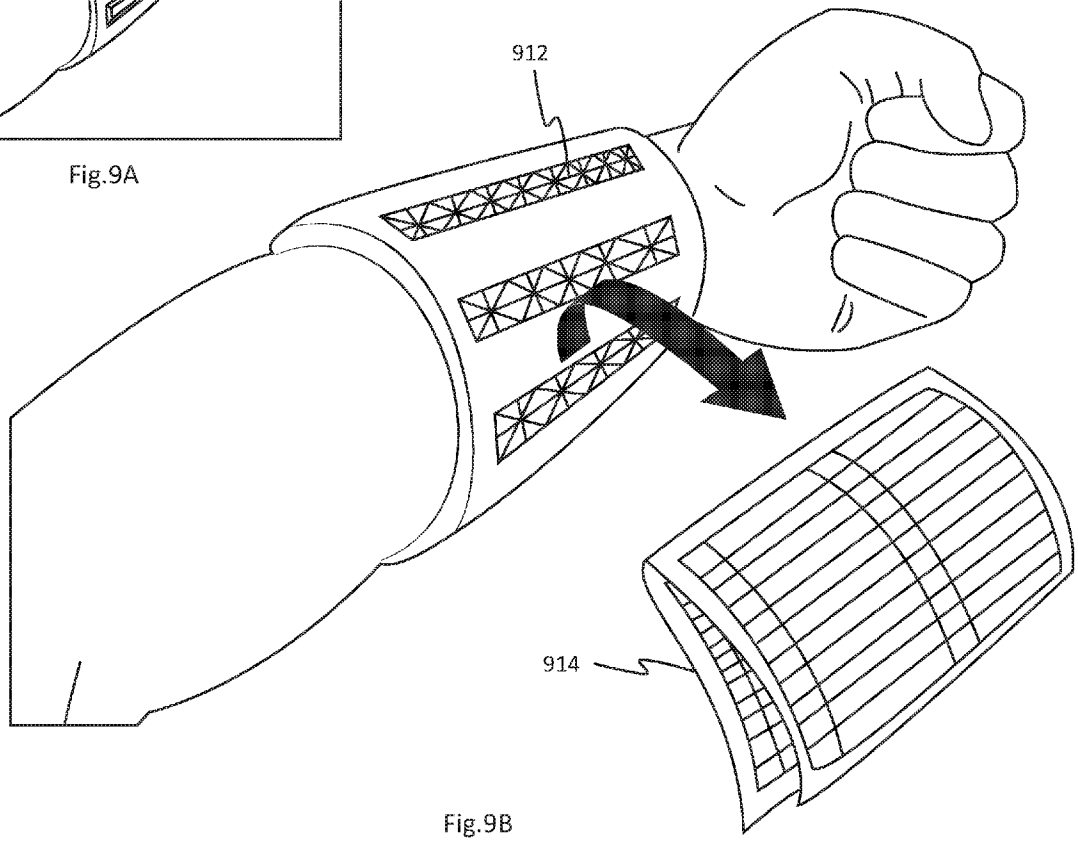

FIG. 9A illustrates a sweatband 904 mounted on a user's arm 902 with recessed portions 906 for the first sheet fastening portions. Referring to FIG. 9B, the first sheet fastening portions 912 fit into said recesses such that the detachable sheet 914 lays flat on top of the sweatband. This provides a very comfortable fit to the user.

Example

A detachable wrist coach was made according to the design described in FIGS. 3A to 3D and 5A to 5D. The sweatband 300 was made of a smooth cotton/spandex material. When unstretched, it had a uniform circumference of about 20 cm and a length of about 13 cm. When it was fully stretched, the circumference was about 28 cm. The sheet fastening portions 304, 305, 306, 312, 313, and 314 were three Velcro strips. Each strip was about 2 cm wide by about 12.5 cm long. The spacing between the Velcro strips was about 1 cm. The window 502 in the detachable sheet had a width of about 7 cm and a length of about 12 cm. The windows 512 and 514 in the flap were similarly dimensioned. The flap fastening portions 504 and 518 were Velcro strips. The Velcro strips were about 1 cm wide by 12 cm long.

The detachable wrist coach was worn by a user during an American football practice. The detachable sheet stayed on during practice and said Quarterback could open and close said flap without said detachable sheet coming off the sweatband. After the practice, the sweatband was detached from the sheet and washed. The detachable sheet and flap were wiped clean without the transparent pockets becoming cloudy or water getting trapped between them.

Alternative Embodiments

The sheet fastening portions can be any joining method that is attachable and detachable by hand. Sheet fastening portions, for example, may be snaps, sticky tape, magnetic closures, buttons, interlocking plastic closure strips, such as those found on Ziploc® food storage bags. Ziploc is a registered trademark of S. C. Johnson & Son, Inc. For sheet fastening portions that are either fully closed or fully open, such as snaps, the opening force as opposed to peel strength is the appropriate design parameter to allow, for example, the opening of a flap without removal of a detachable sheet from a sweatband.

Conclusion

Having thus described a presently preferred embodiment of the present invention, it will be understood by those skilled in the art that many changes in construction and widely differing embodiments and applications of the invention will suggest themselves without departing from the scope of the present invention as defined in the claims. The disclosures and the description herein are intended to be illustrative and are not in any sense limiting of the invention, defined in scope by the following claims. Any features described herein may be combined with any other feature to provide the benefits indicated for each feature.

We claim:

1. A detachable wrist coach comprising:

a) a tubular sweatband dimensioned to fit over a user's arm, said sweatband comprising a first fold-over fastening portion; and b) a detachable sheet comprising a second fold-over fastening portion wherein:

c) said first fold-over fastening portion comprises a fold-over hinge;

d) said second fold-over fastening portion comprises a front and back side wherein each of said front and back side can join to said first fold-over fastening portion; and e) said first fold-over fastening portion is folded over said second fold-over fastening portion such that first fold-over fastening portion is joined to both of said front side and said back side of said second fold-over fastening portion to form a sandwich structure.

2. The detachable wrist coach of claim 1 wherein:

a) said first fold-over fastening portion comprises a loop fabric; and b) said second fold-over fastening portion comprises a front side of hook fabric joined back-to-back with a back side of hook fabric.

3. The detachable wrist coach of claim 1 wherein:

a) said first fold-over fastening portion comprises a hook fabric; and b) said second fold-over fastening portion comprises a front side of loop fabric joined back-to-back with a back side of loop fabric.

4. The detachable wrist coach of claim 1 wherein said second fold-over fastening portion is joined to said detachable sheet by a sheet hinge such that said detachable sheet can be folded flat against said tubular sweat band.

5. The detachable wrist coach of claim 4 wherein:

a) said sleeve comprises a first closure portion spaced apart from said first fold-over fastening portion;

b) said detachable sheet comprises a second closure portion spaced apart from said second fold-over fastening portion and opposite of said first closure portion; and c) said detachable sheet is folded against said sleeve such that said first closure portion is joined to said second closure portion.

6. The detachable wrist coach of claim 5 wherein said first and second closure portions are a hook-and-loop fastener.

* * * * *